US007923425B2

(12) United States Patent
Held

(10) Patent No.: US 7,923,425 B2
(45) Date of Patent: Apr. 12, 2011

(54) LOW-FOAMING, ACIDIC LOW-TEMPERATURE CLEANER AND PROCESS FOR CLEANING SURFACES

(75) Inventor: Theodore D. Held, Grosse Pointe Farms, MI (US)

(73) Assignee: Henkel AG & Co. KGaA, Duesseldorf (DE)

( * ) Notice: Subject to any disclaimer, the term of this patent is extended or adjusted under 35 U.S.C. 154(b) by 665 days.

(21) Appl. No.: 11/842,448

(22) Filed: Aug. 21, 2007

(65) Prior Publication Data

US 2008/0045439 A1 Feb. 21, 2008

Related U.S. Application Data

(60) Provisional application No. 60/839,322, filed on Aug. 21, 2006.

(51) Int. Cl.
*C11D 1/722* (2006.01)
*C11D 3/20* (2006.01)

(52) U.S. Cl. ..... 510/210; 510/197; 510/199; 510/202; 510/238; 510/243; 510/245; 510/253; 510/254; 510/363; 510/365; 510/421; 510/432; 510/488

(58) Field of Classification Search ..... 510/197, 510/199, 202, 210, 238, 243, 245, 253, 254, 510/363, 365, 421, 432, 488
See application file for complete search history.

(56) References Cited

U.S. PATENT DOCUMENTS 3,957,529 A 5/1976 Alexander et al.
4,116,713 A 9/1978 Otrhalek et al.
4,842,758 A 6/1989 Crutzen
4,846,897 A 7/1989 Nakagawa et al.
4,877,459 A * 10/1989 Cockrell, Jr. et al. ..... 134/40
5,145,608 A * 9/1992 Wershofen ..... 510/219
5,294,364 A 3/1994 Thomas et al.
5,556,616 A 9/1996 Janchitraponvej et al.
5,583,265 A 12/1996 Woo et al.
5,607,913 A 3/1997 Woo et al.
5,612,308 A 3/1997 Woo et al.
5,639,722 A 6/1997 Kong et al.
5,645,823 A 7/1997 Thrall et al.
5,672,578 A 9/1997 Carrie et al.
5,807,816 A 9/1998 Cottrell et al.
5,909,745 A 6/1999 Ali et al.
5,998,358 A 12/1999 Herdt et al.
6,037,319 A 3/2000 Dickler et al.
6,077,501 A 6/2000 Sickora et al.
6,093,218 A 7/2000 Hall et al.
6,121,219 A 9/2000 Herdt et al.
6,171,404 B1 1/2001 Bhatia et al.
6,184,190 B1 2/2001 D'Ambrogio et al.
6,239,092 B1 5/2001 Papasso et al.
6,242,411 B1 6/2001 D'Ambrogio et al.
6,302,969 B2 10/2001 Moster et al.
6,472,358 B1 10/2002 Richter et al.
6,593,279 B2 7/2003 VonKrosigk et al.
6,596,682 B1 7/2003 Gorliln et al.
6,602,837 B1 8/2003 Patel
6,607,718 B1 8/2003 Okuno et al.
6,617,092 B1 9/2003 Patel et al.
6,627,373 B1 9/2003 Patel et al.
6,627,592 B1 9/2003 Shamayeli et al.
6,630,440 B1 10/2003 Song et al.
6,646,145 B1 11/2003 Behler et al.
6,649,368 B1 11/2003 Aghassi et al.
6,652,766 B1 11/2003 Frankenbach et al.
6,656,657 B2 12/2003 Patel et al.
6,656,658 B2 12/2003 Patel et al.
6,663,860 B1 12/2003 Tvedten
6,696,399 B1 * 2/2004 Chernin et al. ..... 510/241
6,723,371 B2 4/2004 Chih-hui
6,727,217 B1 4/2004 Nieendick et al.
6,730,642 B1 5/2004 Aronson et al.
6,736,857 B2 5/2004 Chang et al.
6,767,410 B2 7/2004 Aubay et al.
6,780,825 B2 8/2004 Piterski et al.
6,784,233 B1 8/2004 Weber et al.
6,794,346 B2 9/2004 Wick et al.
6,800,593 B2 10/2004 Dobson, Jr. et al.
6,803,046 B2 10/2004 Metcalfe et al.
6,835,700 B1 12/2004 Nieendick et al.
6,835,702 B2 12/2004 Herdt et al.
6,838,078 B2 1/2005 Wang et al.
6,849,586 B2 2/2005 Avery et al.
6,894,026 B1 5/2005 Quay
6,897,037 B2 5/2005 Okada et al.
6,897,186 B2 5/2005 Goodhue, Jr. et al.
6,897,188 B2 5/2005 Gohl et al.
6,897,233 B2 5/2005 Xiang et al.
6,908,895 B2 6/2005 Bakker et al.
6,911,138 B2 6/2005 Motoki et al.
6,924,260 B2 8/2005 Aubay
6,936,396 B2 8/2005 Patel
6,942,954 B2 9/2005 Patel et al.
6,953,485 B2 10/2005 Gardner et al.
6,984,480 B2 1/2006 Vanbesien et al.
7,018,939 B2 3/2006 Sharma
7,030,046 B2 4/2006 Wong et al.
7,030,086 B2 4/2006 Chen et al.
7,494,963 B2 * 2/2009 Ahmed et al. ..... 510/218
2003/0041885 A1 * 3/2003 Held, III ..... 134/36
2004/0002437 A1 * 1/2004 Wilson ..... 510/407
2004/0127375 A1 * 7/2004 Foster ..... 510/201
2007/0267106 A1 * 11/2007 Service ..... 148/253
2010/0003343 A1 * 1/2010 Ramirez et al. ..... 424/616

* cited by examiner

*Primary Examiner* — Charles I Boyer
(74) *Attorney, Agent, or Firm* — Mark K. Cameron

(57) ABSTRACT

Low-foaming industrial cleaning compositions comprising water; (A) at least one carboxylic acid; (B) one or more aromatic, water soluble or dispersible, non-ionic surfactants; and optionally, one or more of the following: (C) one or more salts of carboxylic acids selected from the group consisting of carboxylic acids that are the same as component (A), different from component (A) and mixtures thereof; and (D) an amount of hydrotrope material sufficient to produce a stable homogeneous solution or dispersion of components (A) through (C) in water; (E) a pH adjuster; (F) one or more polyhydric alcohols; and (G) one or more preservatives.

25 Claims, No Drawings

LOW-FOAMING, ACIDIC LOW-TEMPERATURE CLEANER AND PROCESS FOR CLEANING SURFACES

CROSS-REFERENCE

This application claims priority of provisional application 60/839,322 filed in the United States Patent and Trademark Office on Aug. 21, 2006.

FIELD OF THE INVENTION

This invention relates to low-foaming industrial cleaning compositions and processes for cleaning engineering plastic surfaces, composites, metal/plastic composites, as well as metal surfaces including but not limited to aluminum. More particularly, the invention relates to acidic industrial cleaning compositions, which provide cleaning at temperatures as low as 38° C., comprising little or no phosphorus containing or solvent components and having low-foaming characteristics making the cleaners suitable for use in spray processes for cleaning surfaces.

BACKGROUND OF THE INVENTION

Numerous compositions and processes for cleaning plastic surfaces in an industrial setting are currently known in the art. Most of them contain acid, surfactant(s), and phosphates. Alkaline cleaners are also known to provide good removal of oily soils, but are considered undesirable for certain uses, such as by way of non-limiting example cleaning polymeric materials. Alkaline cleaners have drawbacks including difficulty in controlling etch rate and bath parameters, as well as residue left behind on the cleaned surface. Also, in some locations, phosphates are forbidden or severely limited to avoid potential pollution and eutrophication of bodies of water that receive discharges of industrial waste water. Thus, acidic cleaning compositions that contain little or no phosphorus-containing components, but are still effective cleaners have been sought.

Acidic cleaners are known for use in removing industrial contaminants, such as forming lubricants, fingerprints and other soils prior to further treatment steps or coating. Conventional acidic cleaners require working bath temperatures of at least 130° F. for effective cleaning. While the high temperatures facilitate cleaning and have the added benefit of reducing microbial growth in the bath, the high temperature requirements have drawbacks. The need to maintain large volumes of cleaner at temperatures well in excess of ambient temperatures requires heating equipment and energy, which increases the cost of manufacture. High temperature baths also exhibit higher volume loss rates due to evaporation. Finally, more safety precautions must be taken when working with high temperature baths. For these and other reasons, it is desirable to provide an acidic cleaner that provides cleaning, which is at least as good as high temperature acidic cleaners, at measurably lower bath temperatures.

The benefits of running a cleaner bath at low temperature must be balanced against the resulting increase in microbial growth in the cleaner bath. One consideration in any cleaner that comprises organic material, such as surfactants and soils, is the possibility that the cleaner will support microbial growth, e.g. fungal and/or bacterial. Microbial growth can reduce the efficacy of the cleaner, generate sludge and pose a health hazard depending on the species of microbes present.

It is desirable to provide a cleaner that reduces microbial growth both in the concentrate and in the working cleaner bath at low temperature.

A ubiquitous component of alkaline and acidic cleaners is surfactant. A drawback of many surfactants found in conventional products is the foamy nature of the cleaner. Particularly where oily soils are to be removed, the surfactants that work well for dissolving or dispersing oily soils into aqueous solutions generally tend to be foamy. A variety of common household products provide alkaline or acidic cleaner with surfactant, but are quite foamy. While foaming is considered desirable in many consumer products, foaming is undesirable in industrial applications, particularly where pressurized spray cleaners are used. A traditional household cleaner used in such an application rapidly generates unmanageable amounts of foam. It is desirable to provide a low foam cleaner suitable for use in industrial spray cleaning.

SUMMARY OF THE INVENTION

The compositions of the invention are substantially or entirely free from phosphorus-containing components and can be substantially or entirely free from volatile organic solvents as well, and are therefore less polluting than the now common commercial acidic cleaners for plastics are.

One aspect of the invention is a composition that comprises, preferably consists essentially of, or more preferably consists of, water and:

(A) carboxylic acid or acids;

(B) nonionic surfactant; and, optionally, one or more of the following:

(C) salts including anions of carboxylic acid or acids, preferably anions of the same acid or acids as specified for part (A); and (D) a sufficient amount of hydrotrope material to produce a stable homogeneous solution or dispersion of components (A) through (C) in water;

(E) a pH adjuster;

(F) a polyhydric alcohol; and (G) one or more preservatives.

One embodiment of the invention relates to a cleaning composition wherein said cleaning composition comprises no more than about 2 percent by weight of phosphorus-containing components. Independently, the composition may be substantially free from volatile organic solvents. Volatile organic solvents will be understood by those of skill in the art to mean those compounds with closed-cup flash points of less than 38° C. (flammable) and those with flash points between 38° C. and 54° C. (combustible). In addition to the safety and environmental concerns, such materials are susceptible to volatilization leading to loss from the cleaning zone if sprayed in a typical industrial washer, and a need to scrub the volatilized substance from the atmosphere of the plant.

In one embodiment, the composition comprises an amount of component (D) of at least 25-5000 parts per million. Independently, component (D) can be selected from at least one ammonium or alkali metal salt of a sulfonate of toluene, xylene, or cumene.

In another aspect of the invention, component (A) comprises molecules of which each contains at least one carboxyl group and, optionally, additional hydroxyl or carboxyl groups. In one embodiment, (A) is selected from the group consisting of gluconic acid, itaconic acid, hydroxyacetic acid, succinic acid, fumaric acid, potassium acid phthalate, tartaric acid, malonic acid, citric acid and mixtures thereof.

In another aspect of the invention, component (B) comprises one or more alkoxylated aromatic alcohols. In one embodiment, (B) comprises at least one alkoxylated aromatic alcohol having 4 to 6 moles of ethoxylation. In another embodiment, (B) comprises at least one nonionic surfactant selected from a benzyl alcohol ethoxylate and/or a phenol ethoxylate.

In another aspect of the invention the composition may further comprise an additional component of one or more water-soluble solvents selected from ethylene glycol n-butyl ether, diethylene glycol n-butyl ether, triethylene glycol methyl ether, propylene glycol n-butyl ether, dipropylene glycol methyl ether, propylene glycol methyl ether, and propylene glycol n-propyl ether.

In another embodiment of the invention a cleaning composition is provided comprising water and:

(A) about 0.2 g/l to about 6.0 g/l of a component of at least one carboxylic acid wherein said component comprises molecules of which each contains at least one carboxyl group and, optionally, additional hydroxyl or carboxyl groups;

(B) about 50 to about 3000 parts per million, desirably about 100 to about 1000 parts per million, of a component of at least one surfactant;

(C) optionally, one or more salts of carboxylic acids selected from the group consisting of carboxylic acids that are the same as component (A), different from component (A) and mixtures thereof;

(D) about 25 to about 5000 parts per million, desirably about 25 to about 5000 parts per million, of a hydrotrope material, which in a preferred embodiment is a hydrotrope material selected from at least one ammonium or alkali metal salt of a sulfonate of toluene, xylene, or cumene (E) an amount of pH adjuster such that the pH of said composition is not less than 1.0 and not more than 4.0;

(F) optionally, a component of one or more polyhydric alcohols, desirably about 10 to about 2000 parts per million of a component of one or more polyhydric alcohols; and (G) optionally, one or more preservatives.

In a related embodiment:

(A) may be selected from the group consisting of gluconic acid, itaconic acid, hydroxyacetic acid, succinic acid, fumaric acid, potassium acid phthalate, tartaric acid, malonic acid, citric acid and mixtures thereof;

(B) may be selected from alkoxylated aromatic alcohols containing one or more compounds with an aromatic ring and ethoxylate units of general formula I:

I

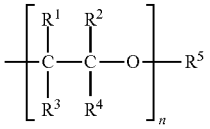

wherein: $R^1$, $R^2$, $R^3$ and $R^4$ are independently selected from hydrogen and methyl; $R^5$ is hydrogen; and n is 2, 3, 4, 5 or 6; said units of formula I being attached to the aromatic ring directly or through an ether (oxygen) linkage or an oxymethylene (—$CHR^8O$—) linkage, wherein $R^8$ is hydrogen or $C_1$-$C_4$ alkyl; and includes the following:

(D) about 25 to about 5000 parts per million of a hydrotrope material;

(E) an amount of pH adjuster such that the pH of said composition is not less than 1.0 and not more than 4.0;

(F) optionally, a component of one or more polyhydric alcohols; and (G) optionally, one or more preservatives.

In a another embodiment, of a composition according to the invention:

(A) comprises citric acid;

(B) comprises at least one alkoxylated benzyl alcohol having 2 to 6 moles of ethoxylation;

(D) comprises at least one ammonium or alkali metal salt of a sulfonate of toluene, xylene, or cumene; and the cleaning composition comprises no more than about 2 percent by weight of phosphorus-containing components and no more than about 2 percent by weight of volatile organic solvents.

Another embodiment of the invention is an aqueous concentrate that can be diluted with water only to produce, optionally after adjustment of pH by adding acid or base, a composition as given above ready for use as such in cleaning surfaces, such as by way of non-limiting example plastic and metal surfaces. The term "water only" herein is intended to include water from normal domestic and industrial water supplies as well as deionized, distilled, or other specially purified water. In one embodiment, a cleaning composition as described herein is produced by diluting an aqueous concentrate with water only, optionally after adjustment of pH by adding acid or base, said aqueous concentrate being present in an amount of from about 0.5 to about 5 vol % of the composition.

A process according to this invention comprises contacting a soiled surface with a suitable composition as described herein for a sufficient time at a sufficiently high temperature to achieve the desired amount of soil removal. Desirably, the cleaner provides at least 60% soil removal when used at a temperature of 100-150° F.

In one embodiment, a process for cleaning a soiled surface that comprises: 1) contacting a soiled surface with a cleaning composition as described herein under the following conditions: the composition is at a temperature of at least 35 to about 70° C.; the surface is contacted with the composition for a time of contact of from about 20 to about 120 seconds; and 2) thereafter, optionally, rinsing the surface with water. In another embodiment of the process, the composition is at a temperature of about 42 to about 60° C.; and the surface is contacted with the composition for a time of contact of from about 20 to about 120 seconds.

Examples of plastic surfaces that can be effectively cleaned according to this invention include, but are not limited to, polyester sheet molding compound ("SMC"); poly{vinyl chloride} ("PVC") homopolymers and copolymers; polyurethane and polyurea plastic surfaces such as those of objects made commercially by injection molding from these plastics; terpolymers of acrylonitrile, butadiene, and styrene ("ABS"); poly(phenylene oxide), hereinafter referred to as "PPO", and copolymers of "phenylene oxide" with other materials such as polyamides; polycarbonate ("PCO") polymers and copolymers; and thermoplastic polyolefins ("TPO"). Examples of metal surfaces that can be effectively cleaned include light metals, ferrous metals and nonferrous metals; in particular magnesium, magnesium alloys, zinc, zinc alloys, aluminum, aluminum alloys, as well as substrates coated with zinc, zinc alloys, aluminum and aluminum alloys, such as Galvalume and Galvaneal. Also within the scope of the invention is cleaning painted surfaces and substrates formed by lamination of special surfacing films or hard laminates.

In one embodiment, an additional component of low volatility solvent is added. Suitable solvents include by way of non-limiting example, water-soluble solvents such as lower alcohols and glycol ethers such as ethylene glycol n-butyl ether, diethylene glycol n-butyl ether, triethylene glycol methyl ether, propylene glycol n-butyl ether, dipropylene glycol methyl ether, propylene glycol methyl ether, and propylene glycol n-propyl ether.

Except in the claims and the operating examples, or where otherwise expressly indicated, all numbers in this description indicating amounts of material or conditions of reaction and/or use are to be understood as modified by the word "about" in describing the broadest scope of the invention. Practice within the numerical limits stated is generally preferred. Also, unless expressly stated to the contrary: percent, "parts of", and ratio values are by weight; the term "polymer" includes "oligomer", "copolymer", "terpolymer", and the like; the description of a group or class of materials as suitable or preferred for a given purpose in connection with the invention implies that mixtures of any two or more of the members of the group or class are equally suitable or preferred; description of constituents in chemical terms refers to the constituents at the time of addition to any combination specified in the description, or as reduced or increased in amount in situ by acid-base reactions, and does not necessarily preclude chemical interactions among the constituents of a mixture once mixed; specification of materials in ionic form implies the presence of sufficient counterions to produce electrical neutrality for the composition as a whole (any counterions thus implicitly specified should preferably be selected from among other constituents explicitly specified in ionic form, to the extent possible; otherwise such counterions may be freely selected, except for avoiding counterions that act adversely to the objects of the invention); the term "mole" and its variations may be applied to elemental, ionic, and any other chemical species defined by number and type of atoms present, as well as to compounds with well defined molecules; an equivalent of acid is to be understood as the amount that would provide one gram atom of hydrogen atoms upon complete ionization; and an equivalent of the salt of such an acid is to be understood as the amount of the salt that requires the replacement of some other cations with one gram atom of hydrogen ions to regenerate the free acid. Other than in the operating examples, or where otherwise indicated, all numbers expressing quantities of ingredients, reaction conditions, or defining ingredient parameters used herein are to be understood as modified in all instances by the term "about".

DETAILED DESCRIPTION OF EMBODIMENTS

Within the broadest scope of the invention, any organic acid made up of molecules of which each contains at least one carboxyl group and, optionally, additional hydroxyl or carboxyl groups, may be used for ingredient (A) above. Thus, for example, gluconic acid, itaconic acid, hydroxyacetic acid, succinic acid, fumaric acid, potassium acid phthalate, tartaric acid, malonic acid, and citric acid could all be used. It is desirable that (A) comprise carboxylic and/or hydroxycarboxylic acids. Desirably the acids include citric, itaconic, hydroxyacetic, succinic, malonic, fumaric and/or RAP. The most preferred acid for ingredient (A) is citric acid. In a working composition as described herein, the concentration of the total of component (A) and component (C) when the latter is present desirably is, with increasing preference in the order given, not less than 0.2, 0.3, 0.4, 0.5, 0.6, 0.7, 0.8, 0.9, 1.00, 1.05, 1.06, 1.07, 1.08, 1.09, 1.10, 1.11 grams per liter (hereinafter usually abbreviated as "g/l") and independently preferably is, with increasing preference in the order given, not more than, at least for reasons of economy, 6.0, 5.7, 5.4, 5.2, 5.1, 5.0, 4.7, 4.4, 4.2, 4.1, 4.0, 3.7, 3.4, 3.2, 3.1, 3.0, 2.7, 2.4, 2.2, 2.1, 2.0, 1.9, 1.8, 1.7, 1.6, 1.5, 1.4, 1.3, 1.2 g/l.

Within the broadest scope of the invention, any conventional aromatic, non-ionic surfactant that is water soluble or dispersible may be used for component (B). Preferred molecules for this component are generally alkoxylated aromatic alcohols, such as phenol and/or benzyl alcohol substituted with suitable amounts of ethylene oxide, and optionally also with some propylene or other higher alkylene oxides, as generally known in the art.

In one embodiment, the alkoxylated aromatic alcohol contains one or more compounds with an aromatic ring, e.g., a phenyl ring, substituted on at least one position with an aliphatic group containing two or more ethoxylate units. The end ethoxylate unit can be end-capped with a hydrogen, $C_1$-$C_6$ alkyl or phenyl. The aromatic ring can also contain one or more alkyl substituents with one to four carbons. Examples of some alkyl substituents include methyl, ethyl, propyl, and isopropyl.

In one embodiment, the alkoxylated aromatic alcohol contains one or more compounds with an aromatic ring and ethoxylate units of general formula I

I

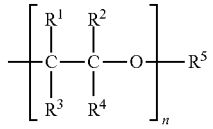

wherein: $R^1$, $R^2$, $R^3$ and $R^4$ are independently selected from hydrogen and methyl; $R^5$ is hydrogen, a $C_1$-$C_6$ alkyl, or phenyl; and n is 2, 3, 4, 5 or 6. The ethoxylate unit of formula I is attached to the aromatic ring directly or through an ether (oxygen) linkage or an oxymethylene (—$CHR^8O$—) linkage, wherein $R^8$ is hydrogen or $C_1$-$C_4$ alkyl.

One type of an ethoxylated aromatic alcohol composition contains one or more ethoxylated compounds of general formula II with a number average (Navg.) of ethoxylate units from about 3 to about 8, wherein $R^1$, $R^2$, $R^3$, $R^4$ and $R^5$ are as defined in formula I, and $R^6$, $R^7$ and $R^8$ are independently selected from hydrogen and $C_1$-$C_4$ alkyl. The substituents $R^1$, $R^2$, $R^3$ and $R^4$ may combine to be at least 60 atom %, or at least 80 atom %, hydrogen. Also, it is preferred that if Navg. is less than four, then $R^5$ is hydrogen.

II

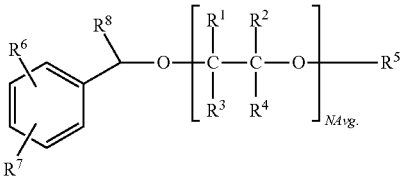

Still another type of an ethoxylated aromatic alcohol composition contains one or more ethoxylated compounds of general formula III with a number average (Navg.) of ethoxylate units from about 3 to about 8, wherein $R^1$, $R^2$, $R^3$, $R^4$ and $R^5$ are as defined in formula I, and $R^6$ and $R^7$ are independently selected from hydrogen and $C_1$-$C_4$ alkyl. The substituents $R^1$, $R^2$, $R^3$ and $R^4$ may combine to be at least 60%, or at least 80%, hydrogen atoms. Also, it is preferred that if Navg. is less than four, then $R^5$ is hydrogen.

III

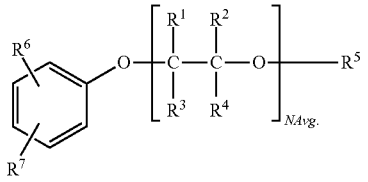

It is to be understood that cleaning compositions of the invention are not limited to the type of commercially available alkoxylated aromatic alcohols recited herein. These types of alcohols are provided only as examples of surface active compositions that can be used in the cleaning solution compositions of the invention. Applicants emphasize that if an aromatic ethoxylated alcohol is used in the cleaning composition of the invention, the aromatic ethoxylated alcohol is of the general class of compounds defined with an ethoxylate group of formula I attached to an aromatic organic moiety.

Independently, the concentration of component (B) in a working composition as described herein preferably is, with increasing preference in the order given, not less than 50, 75, 100, 150, 155, 160, 165, 170, 175, 180, 185, 190, 195, 197 parts per million (hereinafter usually abbreviated as "ppm") and independently preferably is, with increasing preference in the order given, not more than, at least for economy, 3000, 2000, 1000, 900, 800, 700, 600, 500, 400, 300 ppm.

A hydrotrope is defined generally as a substance that increases the solubility in water of another material that is only partially soluble. Within the context of this specification, a hydrotrope is a material that increases the solubility in water, and more particularly in water containing substantial amounts of salts, of component (B) as defined above. Hydrotrope component (D) is usually preferred in the composition if there is a relatively large amount of salt present in the composition, salt which might otherwise tend to reduce the solubility of non-ionic surfactants and organic materials to a level where the ability of the composition to remove and disperse organic soils is less than is desirable. The presence of a hydrotrope, preferably an ammonium or alkali metal salt of a sulfonate of toluene, xylene, or cumene, makes possible the presence of relatively high amounts of both salt and nonionic surfactant in an aqueous solution. The most preferred hydrotrope is sodium cumene sulfonate.

A concentration in parts per million of hydrotrope equal to from one quarter to three quarters of the concentration, or more preferably from 35 to 45% of the concentration, of salt component (C) present is generally preferred when component (C) is present, but a hydrotrope may also be useful in compositions even without component (C), to solubilize some or all of the nonionic surfactants and other organic materials present in the cleaner. The concentration of hydrotrope in a composition can vary widely, depending upon, by way of non-limiting example, the type of hydrotrope, the quantity and type of acidic salt components present, the nature of the surfactants in the composition and the desired cloud point for the mixture to be influenced. Accordingly, a suitable amount of hydrotrope is an amount sufficient to solubilize at least some and preferably all of the nonionic surfactants, most preferably all of the organic materials present in the cleaner. It is desirable that the amount of hydrotrope present in the composition is such that at least 50, 60, 70, 75, 80, 85, 90, 95 wt % of the surfactants present are solubilized. Independently, especially when component (C) is not present in the composition, the amount of hydrotrope in a working composition as described herein preferably is, with increasing preference in the order given, not less than 25, 35, 45, 55, 65, 75, 85, 95, 96, 97, 98, 99, or 100 parts per million (hereinafter usually abbreviated as "ppm") and independently preferably is, with increasing preference in the order given, not more than, at least for economy, 5000, 4500, 4000, 3500, 3000, 2500, 2000, 1500, 1000, 750, 500, 450, 400, 350, 300, 250, 200, 150, or 120 ppm.

As already noted above, one of the major objects of this invention is to avoid phosphate pollution. It is therefore increasingly more preferred that the compositions according to this invention contain no more than 2, 1, 0.5, 0.25, 0.1, or 0.01 percent by weight of phosphate or other phosphorus containing components, such as by way of non-limiting example, anions produced by ionization of phosphoric acids, condensed phosphoric acids and/or esters of phosphates. Similarly, to avoid air pollution and fire hazards, it is increasingly more preferred that the compositions according to this invention contain no more than 2, 1, 0.5, 0.25, 0.1, 0.07, 0.05, 0.03, 0.02, or 0.01 percent by weight of organic materials that could be considered solvents or flammable materials or combustible materials. Examples of such compounds are those with closed-cup flash points of less than 38° C. (flammable) and those with flash points between 38° C. and 54° C. (combustible). In addition to the safety and environmental concerns, such materials are susceptible to volatilization leading to loss from the cleaning zone if sprayed in a typical industrial washer, and a need to scrub the volatilized substance from the atmosphere of the plant. Those of skill in the art will understand "substantially free" to mean no more than 2, 1, 0.5, 0.25, 0.1, 0.07, 0.05, 0.03, 0.02, or 0.01 percent by weight.

The choice of pH and total acid content of a composition according to this invention influences several important properties. These include cleaning effectiveness, pH stability, metal etch and microbial growth. As will be shown, cleaning effectiveness depends on the type of soil cleaned. For triglyceride soils, for example, the higher the pH the more effective the cleaning composition will be. A lower pH favors the removal of soap processing materials, especially zinc and/or calcium stearates, palmitates and similar substances. The pH stability and bath life are enhanced by the presence of large quantities of the acid and salt components, while considerations of economy dictate the use of minimal amounts. Metal etch may be regarded as favorable or unfavorable, depending on the applications. Lower pH and higher total acid content enhances metal etch. Microbial control is influenced by pH and, generally, lower pH values give better microbial control. Thus, a composition is necessarily a compromise among different considerations. Thus, if corrosion is not a problem in the use of the compositions according to this invention, the pH value of a working composition preferably is, with increasing preference in the order given, not less than 1.0, 1.5, 1.7, 1.9, 2.1, 2.2, 2.3, 2.4, 2.5, 2.6, 2.7, 3.0, 3.1, 3.2, 3.25 or 3.3 and independently preferably is, with increasing preference in the order given, not more than 4.0, 3.9, 3.8, 3.7, 3.6, 3.5, 3.45, or 3.4

One reason for providing a high buffer capacity in compositions as described herein which are buffered by the inclusion of optional component (C) as described above is to provide substantial consistency of cleaning effect and other pH influenced performance characteristics, including those discussed above, as the composition is used. In such cases, it may eventually become advantageous to replenish the acid constituent of the composition as it is consumed during use. However, to minimize the frequency of such replacement needed, when the pH of a working composition is above 3.5, the buffering capacity of the composition preferably is high enough to require, with increasing preference in the order given, at least 0.06, 0.10, 0.15, 0.19, 0.23, 0.26, 0.27, 0.28, 0.29, or 0.30 milliequivalents of a strong base per liter of the composition must be added to raise the pH value of the composition by 0.1 pH unit. Accordingly, an optional pH adjuster (E), which can be an acid or a base, is generally preferred to be a base, if used. Generally, the amount of pH adjuster present, measured as equivalent to an amount of alkali metal base, such as NaOH, KOH, LiOH and the like, in a working composition as described herein preferably is, with increasing preference in the order given, not less than 20, 30, 40, 50, 75, 100, 150, 175, 200, 225, 250, 260, 270, 280, 290, or 300 parts per million (hereinafter usually abbreviated as "ppm") and independently preferably is, with increasing preference in the order given, not more than, at least for economy, 1000, 900, 800, 700, 600, 500 or 400 ppm.

Another optional component of the cleaner is a polyhydric alcohol (F). Within the broadest scope of the invention, any conventional aromatic or non-aromatic polyhydric alcohol that is water soluble or dispersible may be used for component (F). Preferred molecules for this component are generally alkyl alcohols having at least two —OH moieties per molecule, preferably at least three such moieties per molecule, such as glycols, glycerol, as generally known in the art. Independently, the concentration of component (F) in a working composition as described herein preferably is, with increasing preference in the order given, not less than 10, 20, 30, 40, 50, 75, 100, 150, 175, 200, 225, 250, 300, 325, or 350 parts per million (hereinafter usually abbreviated as "ppm") and independently preferably is, with increasing preference in the order given, not more than, at least for economy, 2000, 1500, 1000, 900, 800, 700, 600, 500 or 400 ppm. In one embodiment, the working composition comprises 10-70, desirably 20-60, preferably 30-50, most preferably 35-55 ppm.

Optional component (G), a preservative, may be added to reduce any tendency of the composition to support microbial growth. Suitable preservatives include, but are not limited to sodium bisulfite, a minimally toxic reducing agent that interferes with and inhibits microbial growth, as well as benzoic acid and its neutral salts, which are also minimally toxic preservatives. Any preservative, biocide, fungicide, antimicrobial substance known in the art is suitable for use as the preservative (G) where such substance is present in sufficient quantity to prevent or reduce microbial infestation, biofilm formation or other adverse microbial effects resulting from colonization of the cleaner, either in the concentrate or working bath form.

Optional solvent compositions that can be used in the cleaner solutions of the invention include one or more of triethylene glycol monophenyl ether, tetraethylene glycol monophenyl ether, pentaethylene glycol monophenyl ether, hexaethylene glycol monophenyl ether, heptaethylene glycol monophenyl ether, trietylene glycol monobenzyl ether, tetraethylene glycol monobenzyl ether, pentaethylene glycol monobenzyl ether, hexaethylene glycol monobenzyl ether, heptaethylene glycol monobenzyl ether, water-soluble ethoxylates of propylene glycol monophenyl ether (preferably, containing an average of at least 2 oxyethylene moieties per molecule), and the like and mixtures thereof, provided that the solvent meets the criteria of low volatility and low combustibility.

For practical reasons that will be apparent to those skilled in the art, it is strongly preferred to choose components for cleaning compositions according to this invention that have relatively low foaming characteristics at the temperature of actual use. In general, it has been observed that most compositions according to this invention, when measured by the test described above, will have large foam volumes at normal ambient temperatures, but that the amount of foam will decrease dramatically at some temperature below that normally used and preferred for cleaning. This is illustrated below in connection with the specific working examples. It is increasingly more preferred that the foam volume, measured as described above, of a composition for cleaning according to this invention be not more than 25, 20, 15, 12, 10, 8.0, 6.0, 5.0, 4.0, 3.0, 2.0, 1.0 or 0.5 mL at the temperature of actual use for cleaning. If the temperature of intended use is not known, it is increasingly more preferred that the same values for foam volume not be exceeded at 60° C., 54° C., 43° C., or 32° C.

It is normally preferred that a concentrate as described herein have a composition such that a solution of from 0.5 to 5 vol %, desirably 1 to 4 vol %, preferably 2 to 3 vol % of the concentrate in water will be suitable for direct use for cleaning plastics as described above, possibly after pH adjustment as previously noted.

Contacting between the surface and the liquid composition in a process as described herein may be accomplished by any convenient method, such as immersing the surface in a container of the liquid composition, spraying the composition on the surface, or the like, or by a mixture of methods. Any temperature between just above the freezing point and just below the boiling point of the liquid cleaning composition may generally be used, with a temperature of at least 35, 38, 40° C. generally preferred. Upper limits of temperature tend to be about 70° C., based upon economic concerns. Preferred temperature ranges include 42° C. to 60° C., more preferred, 45° C. to 57° C., with the preference strongly influenced by a combination of economics and cleaning power. At the preferred temperatures, a time of contact of from 20-120 seconds is generally preferred, with from 45-75 seconds more preferred.

After cleaning as described immediately above, it is generally preferred to rinse the cleaned surface with water to remove any residue of the cleaning composition before subsequent use or surface finishing of the cleaned plastic. Most preferably, at least the last such rinse should be with deionized or other purified water. Usually, the rinsed surface should then be dried before subsequent finishing treatments. Drying also may be accomplished by any convenient method, such as a hot air oven, exposure to infra-red radiation, dehydrating dryers, microwave heating, or the like.

The practice of this invention may be further appreciated from the following, non-limiting, working examples.

EXAMPLES

The following surfactants were tested in the examples:

Surfactant #1 is an amphoteric surfactant described by the manufacturer as a disodium N-lauryl beta-iminodipropionate.

Surfactant #2 is a nonionic surfactant described by the manufacturer as an ethoxylated linear alcohol.

Surfactant #3 is a nitrogen containing surfactant described by the manufacturer as an alkoxylated ether amine oxide.

Surfactant #4 is a nonionic surfactant described by the manufacturer as an isodecyl alcohol, ethoxylated and chlorinated.

Surfactant #5 is a nonionic surfactant described by the manufacturer as an octyl/decyl alcohol, ethoxylated and propoxylated.

Surfactant #6 is described by the manufacturer as a modified linear $C_{10}$-$C_{14}$ aliphatic polyether mixture that is chlorine capped and ethoxylated.

Surfactant #7 is a nonionic surfactant described by the manufacturer as a benzyl alcohol ethoxylate, $C_6H_5CH_2$—O—($CH_2$—$CH_2$—O)$_n$—H, n=2.

Surfactant #8 is a nonionic surfactant described by the manufacturer as a PEG-15 rosin acid.

Surfactant #9 is a nonionic surfactant described by the manufacturer as a modified primary alcohol ethylene oxide adduct.

Surfactant #10 is a nonionic surfactant described by the manufacturer as made from linear $C_{14-15}$ alcohol with 12.9 moles (average) of ethylene oxide.

Surfactant #11 is a nonionic surfactant described by the manufacturer as an oleyl alcohol polyglycol ether substituted with 20 moles of ethylene oxide.

Surfactant #12 is an amphoteric surfactant described by the manufacturer as a disodium capryloamphodipropionate.

Surfactant #13 is a nonionic surfactant described by the manufacturer as a benzyl alcohol ethoxylate, $C_6H_5CH_2$—O—($CH_2$—$CH_2$—O)$_n$—H, n=4.

Surfactant #14 is a nonionic surfactant described by the manufacturer as difunctional block copolymer terminating in primary hydroxyl groups.

Surfactant #15 is described by the manufacturer as an EO/PO fatty alcohol blend, 50% in water.

Surfactant #16 is a nonionic surfactant described by the manufacturer as a benzyl alcohol ethoxylate, $C_6H_5CH_2$—O—($CH_2$—$CH_2$—O)$_n$—H, n=5.

Surfactant #17 is a nonionic surfactant described by the manufacturer as a benzyl alcohol ethoxylate, $C_6H_5CH_2$—O—($CH_2$—$CH_2$—O)$_n$, —H, n=6.

Surfactant #18 is a nonionic surfactant described by the manufacturer as a phenol ethoxylated with 4 moles of ethylene oxide.

Surfactant #19 is a nonionic surfactant described by the manufacturer as a phenol ethoxylated with 6 moles of ethylene oxide.

Surfactant #20 is a nonionic surfactant described by the manufacturer as a four mole ethoxylate of benzyl alcohol terminated with a propylene oxide cap.

Example 1

A series of commercially available cleaners as well as certain surfactants and related compounds in water, alone, without a builder matrix were tested for cleaning performance. The cleaning effectiveness of each cleaner composition was tested follows:

1. Soiled aluminum panels, 1"×4", were used as the test specimens. Panels were run in triplicate at 120° F., 90 Seconds Exposure.
2. Mineral oil and corn oil, each modified by the addition of 10% graphite, were used as the soils for each screening. Soil patches on the aluminum were deposited immediately before testing.

The test specimens were cleaned by low-impingement, continuously circulated aqueous working baths to determine chemical cleaning strength. The test also screened for foaminess. The continuous circulation promoted foam formation. Cleaning effectiveness was evaluated gravimetrically and the percentage of oily contaminant removed by the formulation was calculated by comparing soil weights before and after cleaning. This technique is a common procedure in analytic chemistry and will be familiar to those of skill in the art. The results of these experiments are summarized in Tables 1 and 3 as percent reduction of soil.

TABLE 1

| Formulation | Mineral Oil + Graphite (% Reduction at 120° F.) | Corn Oil + Graphite (% Reduction at 120° F.) |
|---|---|---|
| 2% Commercial Cleaner #1 | 1.7 | 5.4 |
| 1% Commercial Cleaner #1 | 16.6 | 20.1 |
| 2% Commercial Cleaner #2 | 16.4 | 22.3 |
| 2% Commercial Cleaner #3 | 91.3 | 95.8 |
| 2% Commercial Cleaner #3, Retest | 89.7 | 90.7 |
| 2% Commercial Cleaner #12 | 84.4 | 14.4 |
| 2% Commercial Cleaner #12, Retest | 77.5 | 14.2 |
| 2% Commercial Cleaner #4 | 27.6 | 10.0 |

The methodology for the following tests was always the same (panels were run in triplicate at 120° F., 90 seconds exposure) except for when a high foaming surfactant was used, the variations described below table were made.

Test Samples 1 and 2 were formulated as recited in Table 2.

TABLE 2

| Ingredient | Test Sample 1 | Test Sample 2 |
|---|---|---|
| Water | 911.7 | 870 |
| Citric acid | 47.5 | 45 |
| 45% KOH | | 46 (to solution clarity) |
| Naxonate SC | 18 | 16 |
| Sodium bisulfite | 0.8 | 0.8 |
| Surfactant #1 | | 3.5 |
| Total | 978 | 981.3 |

Test Samples 1 and 2 were tested for cleaning performance along with several other surfactant types, alone, in water.

TABLE 3

| Substrate | Soil | Surfactant #2, 0.05%, alone, no matrix | Surfactant #3, 0.05%, alone, no matrix | 2% Comm. Cleaner #5 | 2% Comm. Cleaner #6 | 2% Comm. Cleaner #7 | 2% Test Sample 1, no surfactant |
|---|---|---|---|---|---|---|---|
| Aluminum-1 | Min Oil | 75.3% | 96.6% | 19.7% | 96.9% | 62.5% | 88.4% |
| Aluminum-2 | Min Oil | 50.0 | 97.7 | 24.7 | 98.9 | 92.2 | 81.7 |
| Aluminum-3 | Min Oil | 48.0 | 84.1 | 70.5 | 100.0 | 87.3 | 86.7 |
| Aluminum-1 | Corn Oil | 8.1 | 18.7 | 39.4 | 58.3 | 47.2 | 73.5 |
| Aluminum-2 | Corn Oil | 16.3 | 29.3 | 40.6 | 17.5 | 31.7 | 76.8 |
| Aluminum-3 | Corn Oil | 21.2 | 25.0 | 39.6 | 47.0 | 24.1 | 73.7 |

TABLE 4

| Substrate | Soil | 2% Comm. Cleaner #8 | Surfactant #4, 0.05%, alone, no matrix | Surfactant #5, 0.05%, alone, no matrix | Surfactant #6, 0.05%, alone, no matrix | 2% Comm. Cleaner #9 | Tri (propylene glycol) propyl ether, 0.05% |
|---|---|---|---|---|---|---|---|
| Aluminum-1 | Min Oil | 93.0% | 90.4% | 94.6% | 89.5% | 99.0% | 100.0% |
| Aluminum-2 | Min Oil | 81.3 | 89.9 | 85.2 | 88.2 | 100.0 | 93.9 |
| Aluminum-3 | Min Oil | 88.9 | 92.5 | 93.2 | 91.2 | 97.9 | 100.0 |
| Aluminum-1 | Corn Oil | 34.8 | 11.2 | 6.9 | 9.2 | 80.0 | 90.0 |
| Aluminum-2 | Corn Oil | 31.0 | 6.3 | 9.9 | 15.0 | 75.2 | 88.9 |
| Aluminum-3 | Corn Oil | 33.7 | 4.0 | 18.0 | 10.9 | 57.7 | 95.0 |

Surfactant #6 is a chlorine-capped linear alcohol ethoxylate. This is a significantly foamy material, which had to be run at a 60% power level and no sparge air.

The compound tri(propylene glycol) propyl ether is a slow solvent that is neither a hazardous air pollutant (HAP) nor a volatile organic compound (VOC). This type of compound is known for use in household cleaners at levels on the order of 5%, ready-for-use, to provide solvency and oil holding capacity. The working level of 0.05% in the cleaner bath provides good cleaning of both mineral and corn oils.

TABLE 5

| Substrate | Soil | Surfactant #7, 0.05%, alone, no matrix | 2% Test Sample 2 | Surfactant #8, 0.05%, alone, no matrix | Surfactant #8, 0.05% + Surfactant #9, no matrix | Surfactant #9, 0.05%, alone, no matrix | Surfactant #10, 0.05%, alone, no matrix | Surfactant #11, 0.05%, alone, no matrix |
|---|---|---|---|---|---|---|---|---|
| Aluminum-1 | Min Oil | 100.0% | 81.6% | (49.4%) | 98.9% | 97.9% | 97.9% | 97.0% |
| Aluminum-2 | Min Oil | 98.9 | 92.8 | (86.5) | 96.0 | 100.0 | 94.2 | 100.0 |
| Aluminum-3 | Min Oil | 100.0 | 95.4 | 48.9 | 98.0 | 100.0 | 99.0 | 100.0 |
| Aluminum-1 | Corn Oil | 92.2 | 84.8 | 98.1 | 69.4 | 13.7 | 84.2 | 94.4 |
| Aluminum-2 | Corn Oil | 92.0 | 87.2 | 98.9 | 63.2 | 7.2 | 76.7 | 92.1 |
| Aluminum-3 | Corn Oil | 91.6 | 88.8 | 95.6 | 59.6 | 14.4 | 64.5 | 79.2 |

Surfactant #7 is a benzyl alcohol ethoxylate have 2 moles of ethylene oxide, which provides good removal of the test soils when this material is present, alone.

Surfactant #8 is a foamy surfactant, normally used with a defoamer in the concentrate. The amount of foam required alteration of the method. An air sparge was not used. The test panel was placed by hand into the region of maximum flow turbulence in the cleaner bath. Corn oil removal resulted in a fair amount of defoaming. The setting on the rheostat for pump speed was frequently turned down from "60" to as low as "30" (percent of full-scale power) when running the mineral oil specimens. Otherwise, the foam would have overflowed the container. The corn oil chips were run at the normal "60", which may have resulted in some advantage to the corn oil specimens, giving better cleaning than the mineral oil chips.

Surfactant #8 is ethoxylated rosin. It is so foamy that it needs to be combined with an equal weight of defoamer (Surfactant #9) in order to be commercially usable. Surfactant #9 is a linear alcohol ethoxylate with a stated cloud point of 32-37° C. Unlike the Surfactant #8 alone, this solution displays a cloud point of about 42° C. Adding Surfactant #9 at this level also defoams the system completely. The flow characteristics and the pump speed were at the standard "60" for this test sample.

Surfactant #10 and Surfactant #11 are foamy materials that had to be run with the pump at 40% and no sparge air.

Example 2

New formulations were prepared and tested for cleaning performance according to the procedure of Example 1.

TABLE 6

| Ingredient | A | B | C | D | E | F | G | H |
|---|---|---|---|---|---|---|---|---|
| Water | 892.7 | 885.7 | 888.0 | 870.0 | 872.2 | 868.3 | 870 | 870 |
| Citric Acid | 55.0 | 55.0 | 55.0 | 55.0 | | 55.0 | 55.0 | 55.0 |
| Itaconic acid | | | | | 51.1 | | | |
| 45% KOH | 33.5 | 33.5 | 33.5 | 33.5 | 33.5 | 33.5 | 33.5 | 33.5 |
| Naxonate SC | 17 | 17 | 17 | 17 | 17 | | | |
| Reservol P | | | | | | 17 | | |
| Na bisulfite | 0.8 | 0.8 | 0.8 | 0.8 | 0.8 | 0.8 | 0.8 | 0.8 |
| Surfactant #9 | 6.0 | 6.0 | 3.0 | | | | | |
| Surfactant #11 | 2.0 | | | | | | | |
| Surfactant #7 | | 2.0 | | | | | | |
| Surfactant #12 | | | 12.0 | | | | | |
| Surfactant #13 | | | | 20.0 | | | | |
| Glycerin, 96% | | | | | | | 20.0 | 13.5 |
| Surfactant #14 | | | | | | | | 5 |
| Surfactant #15 | | | | | | | | 1.5 |

TABLE 7

| | | % Reduction at 120° F. | | | | | | | |
|---|---|---|---|---|---|---|---|---|---|
| Substrate | Soil | A 2%, | B 2% | C 2% | D 2% | E 2% | F 2% | G 2% | H 2% |
| Aluminum-1 | Min Oil | 96.7% | 100.0% | 96.1% | 98.9% | 83.0% | 97.0% | 68.4% | 72.2% |
| Aluminum-2 | Min Oil | 95.0 | 96.0 | 90.4 | 100.0 | 87.5 | 96.8 | 78.3 | 86.6 |
| Aluminum-3 | Min Oil | 93.3 | 98.1 | 92.9 | 98.9 | 81.5 | 94.9 | 81.0 | 91.3 |
| Aluminum-1 | Corn Oil | 74.8 | 57.3 | 39.6 | 95.4 | 70.2 | 60.2 | 76.2 | 46.5 |
| Aluminum-2 | Corn Oil | 73.6 | 50.0 | 37.8 | 89.6 | 69.6 | 61.7 | 76.3 | 65.5 |
| Aluminum-3 | Corn Oil | 64.3 | 59.8 | 62.4 | 88.7 | 69.4 | 61.8 | 83.6 | 68.7 |

Formula A was very foamy at 2% and 120° F.

Formula B displays a significant reduction in the power to clean corn oil.

Formula C was fair for mineral oil cleaning, but falling short for corn oil.

Formula D was the first of the prototype materials to move up to the 90%/90% cleaning efficiency level.

Formula E was a formula with itaconic acid in a 1:1 free acidity relationship to citric acid (itaconic acid=65.05 grams per acid equivalent; citric acid monohydrate=70.03 grams per acid equivalent).

A formula was prepared, similar to Formula E, using 55 g citric acid, 910.7 g water, 33.5 g 45% KOH and 0.8 g sodium bisulfite. The cleaning strength of these formulations was as follows:

| | Mineral Oil Removal | Corn Oil Removal |
|---|---|---|
| Itaconic Matrix | 84.0% | 69.7% |
| Citric Matrix | 85.6% | 74.7% |

The cleaning strength averages for the two acid variations were within estimated experimental error of one another. After the test, the spent cleaning solution from the itaconic acid formulation was yellow, which evidences greater steel etch.

Formula F was a phosphate-free formulation made using Reservol P, an (m-nitrobenzene sulfonic acid salt, which required heating to dissolve. Later an excess precipitated out to the concentrate. There is no foam in this system. A degree of yellow color was noted, indicating metal etch.

Comparisons for the Reservol P compositions:

| | Mineral Oil Removal | Corn Oil Removal |
|---|---|---|
| 2% Comm. Cleaner #9 | 99.0% | 71.0% |
| 2% Test Sample 2 | 85.6 | 74.7 |
| Formula F | 96.2 | 61.2 |

The efficacy of Reservol P for organic soil removal appeared to be minimal.

Formula G included glycerin as an attempt to boost corn oil removal. Without being bound to a single theory, the glycerin was believed to facilitate some reorganization of the triglycerides in the corn oil as part of a removal mechanism. A new set of aluminum test panels was used for this test. This formula was low foam and without a cloud point. The average removal rates showed an increase in corn oil removal efficiency, but a reduction in mineral oil removal:

| | Mineral Oil Removal | Corn Oil Removal |
|---|---|---|
| 2% Test Sample 2 | 85.6 | 74.7 |
| Formula G | 75.9 | 78.7 |

Formula H was prepared using Surfactant #14, a common material from BASF, described as an EO-PO block copolymer with relatively little surface tension reduction power. Average molecular weight: 2900. In addition, some glycerin and Surfactant #15, an ethoxylated, propoxylated terpene material, was added. Formula H mixed together well and had no objectionable cloud point. The mixture at 2% produced a medium amount of foam in the test rig. Comparative average cleaning strengths are given below:

| | Mineral Oil Removal | Corn Oil Removal |
|---|---|---|
| 2% Test Sample 2 | 85.6 | 74.7 |
| Formula G | 75.9 | 78.7 |
| Formula H | 83.4 | 60.2 |

A summary of the foregoing results is found Table 8. Only formulas with mineral oil removal rates above 80% are listed. Some drawbacks of each composition are recorded.

TABLE 8

| Description | Mineral Oil | Corn Oil | Comments |
|---|---|---|---|
| 0.05% Surfactant #10 | 97.0 | 75.1 | Foamy |
| 0.05% Surfactant #9 | 99.3 | 11.8 | Low cloud point |
| 0.05% Surfactant #11 | 99.0 | 88.6 | Foamy |
| 2% Formula A | 95.0 | 70.9 | Foamy, low cloud point (F and C) |
| 2% Formula B | 98.0 | 55.7 | Low cloud point |
| 0.05% Surfactant #6 | 89.6 | 11.7 | Foamy |
| 2% Formula C | 93.1 | 46.6 | Low cloud point |
| 2% Formula D | 99.3 | 91.2 | No discernable problems |
| 2% Comm. Cleaner #9 | 99.0 | 71.0 | Phosphated |
| 2% Formula F | 96.2 | 61.2 | Etch |
| 2% Formula H | 83.4 | 60.2 | No discernable problems |

Most requirements for a low foaming efficient cleaner for oily soils, both organic and inorganic, appear likely satisfied by Formula D. It has excellent cleaning for both of the target soils, has very low or non-existent foam at 120° F., and appears to be entirely concentrate stable.

Example 3

New formulations were prepared and tested for cleaning performance according to the procedure of Example 1.

TABLE 9

| Ingredient | I | J | K | L | M | N |
|---|---|---|---|---|---|---|
| Water | 870 | 880 | 885 | 893.7 | 900.7 | 937.9 |
| Citric Acid | 55.0 | 55.0 | 55.0 | 55.0 | 55.0 | 27.5 |
| 45% KOH | | 33.5 | 33.5 | 33.5 | 33.5 | 16.8 |
| 28% $NH_4OH$ | 33.5 | | | | | |
| Naxonate SC | 17.0 | 17.0 | 17.0 | 5.0 | 10.0 | 5.0 |
| Reservol P | | | | | | |
| Na bisulfite | 0.8 | 0.8 | 0.8 | 0.8 | 0.8 | 0.8 |
| Surfactant #12 | | | | | 10 | |
| Surfactant #13 | 20 | 10 | 5 | 10.0 | | 10.0 |
| Glycerin, 96% | | | | 2.0 | | 2.0 |

TABLE 10

| | | % Reduction at 120° F. | | | | | |
|---|---|---|---|---|---|---|---|
| Substrate | Soil | I 2%, | J 2% | K 2% | L 2% | M 2% | N 2%, |
| Aluminum-1 | Min Oil | 96.1% | 100.0% | 100.0% | 100.0% | 53.8% | 100.0% |
| Aluminum-2 | Min Oil | 95.1 | 100.0 | 100.0 | 100.0 | 56.9 | 99.0 |
| Aluminum-3 | Min Oil | 98.1 | 96.1 | 100.0 | 100.0 | 60.4 | 100.0 |
| Aluminum-1 | Corn Oil | 84.8 | 87.4 | 82.0 | 100.0 | 47.7 | 87.8 |
| Aluminum-2 | Corn Oil | 84.6 | 90.7 | 77.7 | 98.1 | 56.3 | 93.1 |
| Aluminum-3 | Corn Oil | 67.2 | 88.2 | 71.1 | 96.6 | 55.2 | 87.1 |

The neutralizing agent was changed from potassium hydroxide to ammonium hydroxide in Formula D to generate Formula I. This formula also had a very high cloud point (over 140° F.) and the foaming in the test rig was about equal to the very low foam levels for Formula D. The following compares the average cleaning percentages for Formula D, neutralized with KOH, and Formula I, with ammonium hydroxide.

| | Mineral Oil Removal | Corn Oil Removal |
|---|---|---|
| Formula D | 99.3 | 91.2 |
| Formula I | 96.2 | 78.9 |

Formula J and K contained different levels of Surfactant #13 than Formula D, which had 20 parts per thousand. Both of these formulas were low foaming and, like Formula D, did not have notable color after the test from steel etch. The following tabulates the cleaning power comparisons of four formulas, listed according to the loading of Surfactant #13.

| Amount of Surfactant #13 | Mineral Oil Removal | Corn Oil Removal |
|---|---|---|
| Formula D, none (zero parts per thousand) | 85.6% | 74.7% |
| 5 parts per thousand | 100.0 | 76.9 |
| 10 parts per thousand | 98.7 | 88.8 |
| 20 parts per thousand | 99.3 | 91.2 |

Corn oil cleaning improved as the level of Surfactant #13 was raised. All samples containing Surfactant #13 had nearly 100% mineral oil removal.

Formula L contained additives of Surfactant #13 and glycerol, and had unexpected beneficial effects on cleaning. Formula L was extremely low foaming at 120° F. and had no notable yellow color pick up suggesting low etch. The cleaning power, at 100% mineral oil and an average of 98.2% corn oil, was a definite improvement over the known cleaners. There was no cloud point below 140° F.

Formula M used Surfactant #12. This formulation was very cloudy, even after the addition of 10 grams of Naxonate SC. The cloudiness settled out after a few days and resists water rinsing. The cloudiness may be an indication of the ins lubility of the surfactant at this pH. There seems to be no indication here of any efficacy for the use of this surfactant, at least at this pH. An average of 57.0% removal for mineral oil and 53.1% for corn oil is distinctly inferior to the results of the previous Formula L.

The performance of Formula N was good, but not quite as good as Formula L at full strength; Formula N's reduced ion strength reduces etch of mild steel.

Additional Cleaning Testing for Formula L

Ordinary human fingerprints, as well as those made with clarified butter, were placed on fresh TPO chips and run through a test rig loaded with Formula L at 120° F., according to the procedure of Example 1. After a dwell time of 120 seconds, all traces of the fingerprints of both types were removed from the plastic surfaces. Contamination with oily soils was made according to the procedure of Example 1 on TPO and run under the same conditions as for the fingerprint test. Both soils were completely removed from the TPO, based on visual estimates. The foregoing testing indicated a good correlation between the quantification test results and the macroscopic cleaning evidence ordinarily used in the manufacturing to determine cleaning effectiveness.

Example 4

Etch tests for Formulas L and N were run according to the following procedure: 1"×4", holed CRS panels were cut, abraded with a Scotch-Brite pad to remove surface corrosion and weighed. Three CRS panels for each bath were submerged in 32-liter working baths of Formulas L or N at the temperatures as recited in Table 11. A heating pump was used to keep the bath temperature constant. The bath was agitated and aerated using air sparging at a rate of approximately 100 ml per minute. After an exposure time of one hour, the CRS panels were removed, dried and re-weighed.

Comparing the etch rates for the two formulations:

TABLE 11

| | 37° C. (98° F.) | 44° C. (112° F.) | 49° C. (120° F.) | 54° C. (129° F.) |
|---|---|---|---|---|
| Formula L, 2 vol % | 167.4 | 231.7 | 251.5 | 303.0 |
| Formula N, 2 vol % | 126.3 | 152.4 | 233.2 | 285.4 |
| % Reduction in loss of metal due to etching using Formula N | 24.6% | 34.2% | 7.3% | 5.8% |

The etch rate reductions vary. But reductions of citrate strength results in etch rate reduction.

Example 5

Formula L's performance at lower temperatures was tested according to the procedure of Example 1. Formula L was run in three separate experiments at 2% and 110° F.; the results are displayed in Table 12. Cleaning effectiveness of working baths against an ordinary human fingerprint on a TPO chip was also assessed.

TABLE 12

| Formula L, 2%, 110° F. | | |
|---|---|---|
| | % Soil Reduction | Average and Std. Deviation |
| Mineral Oil 1 | 97.2 | 98.1 ± 0.8 |
| Mineral Oil 2 | 99.1 | |
| Mineral Oil 3 | 97.1 | |
| Mineral Oil 4 | 98.0 | |
| Mineral Oil 5 | 98.0 | |
| Mineral Oil 6 | 98.9 | |
| Corn Oil 1 | 84.9 | 83.2 ± 2.4 |
| Corn Oil 2 | 85.7 | |
| Corn Oil 3 | 84.3 | |
| Corn Oil 4 | 83.5 | |
| Corn Oil 5 | 86.5 | |
| Corn Oil 6 | 83.3 | |
| Corn Oil 7 | 79.6 | |
| Corn Oil 8 | 81.4 | |
| Corn Oil 9 | 80.2 | |

In addition, water contact angles were used as a cleanliness measure. This measure is significant with regard to reaction-injection-molded polyurethane (RIM) containing internal mold release (IMR) products. RIM presents a different sort of cleaning task than mineral oil and corn oil soils. IMR is normally a mixture of zinc stearate and zinc palmitate, sometimes with other cations such as calcium. (These soaps may also be used on other substrates in the form of external mold release agents applied to mold surfaces.) IMR Works because it bleeds to the part surface. IMR removal is important because IMR interferes with paint adhesion to the RIM substrate.

The presence of the stearate soaps on plastic surfaces, particularly RIM, is easy to detect by the use of water contact angle. Because the soap is so hydrophobic, when it has been cleaned away, the water contact angle on the substrate can be seen to drop between 10° and 20°. The contact angle measures (advancing angle, four drops method) were as follows. Water contact angles for TPO were also measured, although TPO is not typically formed with IMR or stearate-type external mold release products.

TABLE 13

| | Contact Angle Measurement in Degrees, Formula L, 2%, 110° F. | | | | | | |
|---|---|---|---|---|---|---|---|
| | 1 | 2 | 3 | 4 | 5 | Avg. | Std. Dev. |
| Initial: | | | | | | | |
| TPO 1 | 80.0 | 84.5 | 83.0 | 85.5 | 79.0 | 82.2 | ±2.6 |
| TPO 2 | 78.0 | 85.0 | 83.0 | 83.5 | 80.5 | | |
| RIM 1 | 85.0 | 83.5 | 86.0 | 90.5 | 80.5 | 84.6 | ±3.8 |
| RIM 2 | 86.5 | 88.0 | 83.5 | 85.0 | 77.0 | | |
| Final: | | | | | | | |
| TPO 1 | 93.0 | 91.0 | 92.0 | 90.0 | 90.0 | 91.3 | ±1.4 |
| TPO 2 | 91.0 | 90.0 | 90.0 | 92.5 | 93.5 | | |
| RIM 1 | 69.5 | 73.5 | 69.0 | 72.5 | 69.5 | 70.2 | ±2.1 |
| RIM 2 | 72.0 | 72.0 | 67.0 | 69.0 | 68.0 | | |

There was a 14.40 reduction in contact angle for RIM, indicating removal of the hydrophobic stearate residual. The slight increase in water contact angle for TPO, probably accurately reflected the removal of an unknown, but relatively hydrophilic soil.

Formula L was tested again at 2% and 100° F.; the results are displayed in Table 14.

TABLE 14

| Formula L, 2%, 100° F. | | |
|---|---|---|
| | % Soil Reduction | Average and Std. Deviation |
| Mineral Oil 1 | 95.0 | 98.7 ± 1.9 |
| Mineral Oil 2 | 99.1 | |
| Mineral Oil 3 | 99.0 | |
| Mineral Oil 4 | 100.0 | |
| Mineral Oil 5 | 99.1 | |
| Mineral Oil 6 | 100.0 | |
| Corn Oil 1 | 83.2 | 80.2 ± 3.2 |
| Corn Oil 2 | 80.5 | |
| Corn Oil 3 | 82.6 | |
| Corn Oil 4 | 76.4 | |
| Corn Oil 5 | 76.0 | |
| Corn Oil 6 | 82.4 | |

These numbers are quite similar to those for the cleaner temperature of 110° F. There may be a small reduction in the power to clean corn oil, but the mineral oil cleaning strength continues strong at the lower temperature. Fingerprint removal from TPO was tested for the first run at this temperature and the fingerprint was completely removed.

TABLE 15

| | Contact Angle Measurement in Degrees, Formula L, 2%, 100° F. | | | | | | |
|---|---|---|---|---|---|---|---|
| | 1 | 2 | 3 | 4 | 5 | Avg. | Std. Dev. |
| Initial: | | | | | | | |
| TPO 1 | 85.5 | 86.5 | 85.0 | 88.5 | 87.0 | 83.7 | ±3.2 |
| TPO 2 | 81.5 | 81.5 | 80.5 | 79.5 | 81.5 | | |
| RIM 1 | 86.0 | 97.0 | 96.0 | 99.5 | 85.5 | 89.0 | ±6.3 |
| RIM 2 | 82.5 | 82.5 | 84.0 | 86.5 | 90.0 | | |
| Final: | | | | | | | |
| TPO 1 | 91.5 | 91.0 | 90.5 | 93.0 | 92.0 | 90.3 | ±1.9 |
| TPO 2 | 91.5 | 87.0 | 89.5 | 87.5 | 89.5 | | |
| RIM 1 | 69.5 | 70.5 | 67.5 | 68.0 | 67.5 | 70.6 | ±2.7 |
| RIM 2 | 72.0 | 75.0 | 73.0 | 69.0 | 73.5 | | |

The contact angle numbers are consistent with those measured for 110° F.

Example 6

The performance of Formula L was compared to known cleaners at conventional cleaning temperatures, as noted in Table 16. Testing was performed according to the procedure of Example 4.

TABLE 16

| | | Commercial Cleaner #6, 2% | | | Formula L, 2% | |
|---|---|---|---|---|---|---|
| Substrate | Soil | % Reduction, 120° F. | % Reduction, 130° F. | % Reduction, 140° F. | % Reduction, 130° F. | % Reduction, 140° F. |
| Aluminum-1 | Min Oil | 79.2% | 99.0% | 100.0% | 100.0% | 100.0% |
| Aluminum-2 | Min Oil | 88.7 | 98.1 | 100.0 | 97.9 | 98.2 |
| Aluminum-3 | Min Oil | Spoiled, Too hot | 100.0 | 97.4 | 96.1 | 100.0 |
| Aluminum-1 | Corn Oil | Spoiled, Too hot | 71.6 | 58.1 | 96.2 | 89.3 |
| Aluminum-2 | Corn Oil | 31.2 | 45.9 | 35.5 | 91.7 | 88.1 |
| Aluminum-3 | Corn Oil | 40.3 | 40.7 | 44.3 | 96.7 | 87.0 |

The averages for Commercial Cleaner #6, 2%, (84.0% for mineral oil, 35.8% for corn oil) differ somewhat from the average results of 98.6% and 40.9% for this cleaner from Example 1. The fingerprint was not completely removed from the TPO for this test. This cleaner provided poor to no fingerprint removal, as the fingerprint was smeared somewhat, but still readily visible. Table 17 compares the accumulated numbers for mineral and corn oil cleaning for this cleaner from this example and from Example 1 at 120° F.

TABLE 17

| Commercial Cleaner #6, 2% | | |
|---|---|---|
| | % Soil Reduction | Average and Std. Deviation |
| Mineral Oil 1 | 96.9 | 92.7 ± 8.8 |
| Mineral Oil 2 | 98.9 | |
| Mineral Oil 3 | 100.0 | |
| Mineral Oil 4 | 79.2 | |
| Mineral Oil 5 | 88.7 | |
| Corn Oil 1 | 58.3 | 38.9 ± 15.5 |
| Corn Oil 2 | 17.5 | |
| Corn Oil 3 | 47.0 | |
| Corn Oil 4 | 31.2 | |
| Corn Oil 5 | 40.3 | |

The results for Commercial Cleaner #6, 2% at 120° F. appear quite variable, for both mineral oil and corn oil. Corn oil cleaning values are consistently far weaker than those for the Formula L composition are.

At 130° F., the Commercial Cleaner #6, 2%, did not completely remove the fingerprint from TPO. There was still a "slick" remaining, with a bit more smearing and reduction of the definition of the print ridges. The Commercial Cleaner #6, 2%, also did not remove the fingerprint at 140° F., but was an improvement over how it appeared after the treatment at 130° F.

Formula L, 2%, at 130° F., shows excellent performance for both soils. The fingerprint on TPO was not completely removed, but performed as well as the Commercial Cleaner #6, 2%, at 140° F.

The performance of Formula L was basically the same at 140° F. as for 130° F. and still considerably better for corn oil than the Commercial Cleaner #6. The fingerprint removal from TPO was nearly identical with what was seen for Formula L at 130° F. Average contact angles, in degrees, for the cleaners are as follows:

TABLE 18

| Temperature | TPO - Formula L | TPO - CMCL #6 | RIM - Formula L | RIM - CMCL #6 |
|---|---|---|---|---|
| 100° F. | 90.3 ± 1.9 | — | 70.6 ± 2.7 | — |
| 110° F. | 91.3 ± 1.4 | — | 70.2 ± 2.1 | — |
| 120° F. | — | 94.4 ± 1.5 | — | 68.4 ± 2.1 |
| 130° F. | 85.8 ± 2.2 | 88.9 ± 4.5 | 70.4 ± 1.3 | 72.0 ± 2.8 |
| 140° F. | 86.6 ± 2.0 | 85.1 ± 3.3 | 69.2 ± 1.5 | 69.7 ± 3.3 |

The contact angles show a notable consistency between the two substrates. The four TPO values for Formula L average 88.5°; TPO with the Commercial Cleaner #6, 89.5°. For RIM, the Formula L average is 70.1° versus 70.0 for Commercial Cleaner #6. No trend is notable across the temperatures within each category. The RIM values show that Formula L is just as effective at removing zinc stearate as the commercial cleaner Commercial Cleaner #6.

The cleaning strength of Formula L and the Commercial Cleaner #6, both at 2% concentration, for several temperatures is shown in Table 19 (the numbers for Formula L at 120° F. from Example 3):

TABLE 19

| Temperature | Formula L - Min. Oil | CMCL #6 - Min. Oil | Formula L - Corn Oil | CMCL #6 - Corn Oil |
|---|---|---|---|---|
| 100° F. | 98.7% | — | 80.2% | — |
| 110° F. | 98.1 | — | 83.2 | — |
| 120° F. | 100.0 | 92.7 | 98.2 | 38.9 |
| 130° F. | 98.0 | 99.0 | 94.9 | 52.7 |
| 140° F. | 99.4 | 99.1 | 88.1 | 46.0 |

The Formula L runs showed essentially full removal of mineral oil at all temperatures. The standard deviations for these numbers are on the order of those listed above for 100° F. and 110° F. (±1% or 2%). The numbers for the Commercial Cleaner #6 at its target temperature are also consistently in this excellent range. Formula L is stronger in corn oil removal. Although the formulation's strength seems to have a peak in the 120° and 130° range, its performance at all temperatures is significantly better than that of the standard Commercial Cleaner #6. Even at 100° F., the corn oil cleaning strength for Formula L is more than 50% better than the best value for Commercial Cleaner #6 (130° F.).

Example 7

Another aspect of low temperature cleaning that must be addressed is the increased microbial growth rate seen as temperatures of cleaners are allowed to drop from the conventional 130 to 160° F. One of the major concerns about introducing lower temperature plastics cleaners is whether or not the cleaner stage will support microbial growth, especially in baths that will experience a significant amount of "down time", meaning a return to ambient conditions overnight or over other extended periods, such as weekends. The testing can be conducted at any desired temperature and heating cycle, such as a regular warming cycle of 8 hours warm, 16 hours ambient, around the clock, seven days per week. This simulates a moderate use intensity of a single shift per day at the operating temperature selected.

For this experiment, a constant temperature set-up was used. The set-up consisted of 32,653 grams of solution (32,000 grams of tap water and 653 grams of 2%-targetted cleaner product), and a constant temperature device with directed pump circulation. A moderate air sparge ran continuously to maintain an aerobic condition.

To the solution was added an inoculant taken from bacteria and fungi specimens cultured over a period of time and accustomed to life in an acidic cleaner bath, such as that produced from a 2% v/v solution of Formula L. For consistency, inoculation standard concentrations were prepared from concentrated slimes taken from industrial acidic cleaner baths, cultured, homogenized solids separated by moderate filtration and frozen in 2.0 ml aliquots for later use. By this method, a consistent initial microbial population was assured for each experiment.

Microbial population levels were monitored using commercially available agar dip slides for microbial growth, available from commercial sources well known to those of skill in the microbial arts. Population levels were determined visually by comparison of exposed dip slides to published photographs of known population level, after suitable incubation per instructions provided by the manufacturers. In addition, biofilm and other macroscopic growths were periodically monitored by sight. After each experiment, the equipment was mechanically cleaned of macroscopic debris and rinsed several times with tap water. No effort was made to sterilize the system between test runs.

The microbial growth characteristics of a 2% working bath of Formula L at 110° F. were tested according to the procedure below. For this experiment, a simulation of a "worst case" line was prepared wherein the 24-hour day was broken up into an 8-hour duration of higher temperature, followed by a daily ambient condition. In addition, the weekends were uniformly at ambient conditions. Temperature cycling was accomplished with a timer connected to the heater/stirrer unit. A continuous mild air sparge was present in an approximately 8.25 gallon tank. Bacteria were very well controlled at 110° F., with only a few minor readings on a dip slide. A few fungus colonies began late in the experiment. The following table shows the readings recorded. Set-up and inoculation took place on Monday morning.

TABLE 20

| Dip Date and Time | Bacteria | Fungi |
|---|---|---|
| Tuesday AM | $10^3$ | zero |
| Tuesday PM | $<10^2$ | zero |
| Wednesday AM | $<10^2$ | zero |
| Wednesday PM | $<10^2$ | zero |
| Thursday AM | $<10^2$ | zero |
| Thursday PM | zero | zero |
| Friday AM | zero | zero |
| Friday PM | $<10^2$ | zero |
| Monday AM | $<10^2$ | zero |
| Tuesday AM | $10^2$ | zero |

TABLE 20-continued

| Dip Date and Time | Bacteria | Fungi |
|---|---|---|
| Tuesday PM | $10^2$ | zero |
| Thursday PM | $10^2$ | $<10^1$ |
| Friday PM | zero | $10^2$ |
| Monday AM | $<10^2$ | $10^3$ |

Despite favorable dip slide readings, a significant amount of fungus growth was seen in the tank, situated on certain hard surfaces. This fungus growth was not detected by dip slides, since it was not dispersed in the bath.

New formulations were prepared using a variation of Formula L incorporating benzoic acid, as recited in Table 21.

TABLE 21

| Ingredient | L1 | L2 | L3 |
|---|---|---|---|
| Water | 879.2 | 879.2 | 894.7 |
| 45% KOH | 45.5 | 47.0 | 30.0 |
| Benzoic acid | 2.5 | 5.0 | 2.5 |
| Citric acid | 55.0 | 55.0 | 55.0 |
| Sodium bisulfite | 0.8 | 0.8 | 0.8 |
| Glycerin, 96% | 2.0 | 2.0 | 2.0 |
| Naxonate SC | 5.0 | 5.0 | 5.0 |
| Surfactant #13 | 10.0 | 10.0 | 10.0 |
| Total | 1000.0 | 1004.0 | 1000.0 |
| pH | 4.0, slight haze | 4.0, notable haze | 3.36, slight haze |

Formula L1 incorporated 2.5 grams of benzoic acid per thousand grams of Formula L and was made in the order given in the Table due to the limited solubility of benzoic acid in neutral (or acidic) water. Preparation of a 2% solution of Formula L1 resulted in a concentration of benzoic acid/potassium benzoate of 0.005 grams per 100, which is 0.005%.

Formula L2 with a higher benzoic acid level was also prepared. The cleaning performance of Formula L1 was tested using the procedure of Example 1. A 2% concentration of Formula L1 in a working bath at 110° F. provided 92.0% mineral oil removal and 94.2% corn oil removal. In addition, the foam continued to be low and acceptable when the formula contained benzoate.

Formula L2 was tested for microbial growth according to the procedure recited for Formula L. In this test, the bath was cycled continuously with 8 hours at the selected temperature followed by 16 hours at ambient conditions. After three days of circulation and periodic warming, fungus growth was again discernable on the same surfaces in the tank as with plain Formula L. The amount of growth was reduced from the amounts seen with both Formula L runs, but was notable. The amount of growth did not progress after it was first observed. The dip slide results of the experiment are shown in Table 22 for a culture begun on a Monday morning. The readings are expressed as fungi/bacteria.

TABLE 22

| Exposure Date | Monday Reading |
|---|---|
| Tuesday, a.m. | $10^1/10^2$ |
| Tuesday, p.m. | $<10^1/10^2$, with some anaerobes |
| Wednesday p.m. | $10^1$ (5 tiny fungus stars)/$10^4$, concentrated drip |
| Thursday, a.m. | Zero/$10^4$, now colored, concentrated drip |
| Friday, a.m., final | Zero/$10^4$, now colored |

The amount of fungal growth in the tank again did not seem reflective of the dip slide readings due to attachment of the fungi to surfaces. Formula L2 appears to allow an incremental increase in bacteria while reducing the fungus growth moderately. Note that there are several kinds of bacteria in evidence, including anaerobes.

A third formulation, Formula L3, was prepared with a reduced concentrate pH of 3.36 as compared to Formula L (pH 3.58). The concentrate was a mixture with a slight haze at equilibrium, which was concluded to be a colloidal form of benzoic acid. Formula L3 was tested for microbial growth according to the procedure recited for Formula L. After three days of circulation and periodic warming, an extremely small amount of fungus was visible in the tank. The test was continued over the next week in order to observe the longer-term growth pattern. The results of the experiment are shown in Table 23, for a solution prepared on a Monday.

TABLE 23

| Exposure Date | Wednesday, Reading |
|---|---|
| Monday, a.m. | Zero/some anaerobes |
| Tuesday, noon | Zero/some anaerobes plus $<10^2$ |
| Wednesday 1:00 p.m. | Zero/zero |
| Thursday, 8:30 a.m. | Zero/$10^3$ to $10^4$ |
| Monday, a.m., final | $10^1/10^5$ |

The fungal surface growth described for the first experiments with Formula L was present, but reduced in Formula L3. The fungi were also delayed in exhibiting growth.

Example 8

New formulations were prepared according to Table 24. Formulas O-S were tested for cleaning performance on fingerprints on TPO and for foaminess. Fingerprint removal was judged visually.

The foam testing was performed using a test set up of a conventional sort, but where supplemental heating and air sparging had been added. 1000 mL of cleaning composition, ready for actual use in cleaning, was placed in a glass stoppered graduated cylinder with at least 2500 ml capacity. The cylinder and its contents were brought to temperature equilibrium by a heating mantle, but any convenient method, such as a controlled temperature bath can be used. Liquid was circulated vigorously by means of a pump. Supplemental air was used to create an air entrapment level that separates cleaner systems by foaming tendency. The foam created by the circulating pump alone, for example, usually indicated that the cleaners may run with a stable foam level. With added sparge air, which is considered to more closely approximate use in a spray cleaning operation, about half the systems and conditions tested created enough foam to spill out the tube. Foam volume was determined from the graduations on the cylinder by noting the difference between the graduations at the top of the foam and at the top of the underlying liquid composition in the cylinder.

The basic method according to which the tests were conducted is as follows:

1. Prepare 1000 ml of cleaner solution with warm tap water at an initial solution temperature of about 105° F.
2. Pour the cleaner solution into the cylinder and turn on the circulation pump.
3. If necessary, heat the liquid to about 108° F., stop heating at this point and let the temperature rise to 110° F.
4. Turn on the air sparge. Watch the dynamic foam level to make sure the foam does not overflow the tube. The goal is to create as much foam as possible in the system. Increase (or decrease, in some cases) the air flow until the maximum foam generation is achieved. Note, at this point, whether the maximum foam level is one that will overflow the tube or if the solution is proof to foaming over, even at the maximum level of entrained air.
5. Once the desired temperature is achieved, fill the column with foam (or as much as can be generated). Stop air sparging while maintaining circulation via pump. Note the foam level at the end of 120 seconds from the "full" line (liquid level) to the top of the foam as it clings to the glass in the tube. Many times, this will be an approximate figure since the fluid flow can fluctuate. This level is the "dynamic foam".
6. Fill the tube again with foam. This time, shut off both the air sparge and the circulation pump. After 120 seconds, record the final foam level from the "full" line to the low point of the foam in the center of the foam layer (this reading is possible for the still foam because of the steadiness of the foam layer at this time). This level is the "static foam".
7. Restart the circulation pump and the air sparge (as much as possible). Begin the heating once again and warm to about 113° F. At 115° F., repeat steps 5 and 6.
8. Restart the circulation pump and air sparge (as much as possible). Begin heating again and stop at about 118° F. At 120° F., repeat steps 5 and 6.
9. Repeatedly rinse the apparatus until no evidence of foaming tendency remains (this may take several complete rinses and purges).

The results of the experiment are shown in Table 24.

TABLE 24

| Ingredient | O | P | Q | R | S |
|---|---|---|---|---|---|
| Water | 900.7 | 900.7 | 900.7 | 900.7 | 900.7 |
| Citric Acid | 55.0 | 55.0 | 55.0 | 55.0 | 55.0 |
| 45% KOH | 33.5 | 33.5 | 33.5 | 33.5 | 33.5 |
| Na bisulfite | 0.8 | 0.8 | 0.8 | 0.8 | 0.8 |
| Surfactant #16 | 10.0 | | | | |
| Surfactant #17 | | 10.0 | | | |
| Surfactant #20 | | | 10.0 | | |
| Surfactant #18 | | | | 10.0 | |
| Surfactant #19 | | | | | 10.0 |
| Glycerin, 96% | 2.0 | 2.0 | 2.0 | 2.0 | 2.0 |
| Naxonate SC | 5.0 | 5.0 | 5.0 | 5.0 | 5.0 |
| Total | | | | | |
| Foaminess | OK, ¼" after 30 sec | Less than Formula O | None | OK, ¼" after 30 sec | OK, ¼" after 30 sec |

TABLE 24-continued

| Ingredient | O | P | Q | R | S |
|---|---|---|---|---|---|
| Appearance | Light blue | | Solution cloudy | Light blue haze | Very slight haze |
| Fingerprint removal from TPO | Trace remaining | Complete | Trace remaining | Partial removal | Complete |

Formulas O-S were also tested according to the procedure of Example 1 and compared to the results for Formula L, see Table 25.

TABLE 25

| Formula | Surfactant | % Removal of Mineral Oil | % Removal of Corn Oil |
|---|---|---|---|
| L | Surfactant #13 | 98.1 | 83.2 |
| O | Surfactant #16 | 97.6 | 86.3 |
| P | Surfactant #17 | 100.0 | 91.0 |
| Q | Surfactant #20 | 97.7 | 82.9 |
| R | Surfactant #18 | 94.3 | 77.5 |
| S | Surfactant #19 | 93.0 | 83.7 |

Formula P material was especially good. Formulas R and S scored well, but the appearance of the cleaned panels, especially those for corn oil, was notably dark with residual graphite. Formula P left very clean aluminum chips at the end of the cleaning run. None of the formulations appears to have sufficient turbidity to interfere with package stability and none are excessively foamy so as to unacceptable for commercial use.

Example 9

New formulations were prepared and tested for stability. The cool temperature stability (ordinary refrigeration, 35° F. to 45° F.) of concentrates and working baths of the following formulations were tested.

TABLE 26

| Ingredient | T | U |
|---|---|---|
| Water | 894.7 | 938.9 |
| Citric Acid | 55.0 | 37.3 |
| 45% KOH | 15.0 | 10.2 |
| Na bisulfite | 0.8 | 0.6 |
| Surfactant #13 | 10.0 | 6.8 |
| Benzoic acid | 2.5 | 1.7 |
| Glycerin, 96% | 2.0 | 1.4 |
| Naxonate SC | 5.0 | 3.4 |
| pH | 2.74 | |

The Formula T concentrate prepared was slightly hazy, but appeared stable. The 2% bath had no haze at all. Formula U appeared to be completely stable at 35° F. Formula U working baths were made up at 3% to achieve the net active materials in the working solution and were stable.

Formula T was also tested for microbial growth at two concentrations: 1% and 2%. The test was performed according to the procedure used for Formula L2, with 8 hours at a temperature of 105° F., 16 hours ambient, seven days a week. This experiment began with initial build up on Thursday, Day 1 and ended on Monday, Day 12. The dip slide readings shown in Table 27 were gathered and read on Day 13.

TABLE 27

| Exposure Date | Formula T, 2% Fungus count/ Bacteria count | Exposure Date | Formula T, 1% Fungus count/ Bacteria count |
|---|---|---|---|
| Thursday, a.m. | $10^2$/zero | Begin, Monday | Inoculation |
| Friday, a.m. | $<10^2$/zero | Tuesday a.m | 8 colonies fungus, both sides, $10^3$ to $10^4$ bacteria |
| Friday, p.m. | $10^2$/zero | Wednesday, a.m | 3 colonies fungus, both sides, $10^4$ to $10^5$ bacteria |
| Monday, a.m. | Zero/$10^4$ | Thursday, a.m., | 10 colonies fungus, both sides, $10^5$ to $10^6$ bacteria |
| Wednesday, a.m. | $10^1/10^4$ or 5 (2 types) | | |
| Friday, a.m. | $<10^1/<10^2$ | | |
| Monday, a.m. | Zero/zero | | |

The dip slide readings for Formula T at 2% showed some variation. Microbial inhibition appeared to become more effective with time, where both fungal and bacterial populations dropped to zero by day 12. No visible fungal accumulations on hard surfaces or otherwise were seen during the entire experiment.

A microbial culture was made, cycling up to 105° F., using 1% of Formula T (2.5 g/M benzoic acid, package pH 2.75) and abundant bacteria and fungi were observed, both on dip slides and on the tank equipment. In addition, macroscopic fungus growth was observed by Wednesday in the bath on the hard surfaces described earlier.

Another tank was set up containing 2% of Formula L, from Example 7. Formula L was chosen to ensure a fairly quick response for visible fungus. A microbial growth test was performed according to the procedure used to test Formula L2, with the difference that the temperature was set to rise daily to 115° F. rather than 105° F. The experiment began on Tuesday. By Friday, a small amount of macroscopic fungi was visible. By Monday, the growth was extensive, much like it was in the original Formula L test.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A cleaning composition comprising water and:

(A) at least one carboxylic acid;

(B) one or more aromatic, water soluble or dispersible, non-ionic surfactants selected from alkoxylated aromatic alcohols having no alkyl, ring substituents; and alkoxylated aromatic alcohols having one or more alkyl, ring substituents of one to four carbons;

(C) an amount of hydrotrope material sufficient to produce a stable homogeneous solution or dispersion of components (A) through (C) in water, wherein component (C) is selected from at least one ammonium or alkali metal salt of a sulfonate of toluene, xylene, or cumene; and optionally, one or more of the following:

(D) one or more salts of carboxylic acids selected from the group consisting of carboxylic acids that are the same as component (A), different from component (A) and mixtures thereof;

(E) a pH adjuster;

(F) one or more polyhydric alcohols; and (G) one or more preservatives;

wherein said cleaning composition comprises no more than about 1 percent by weight of phosphorus-containing components.

2. The composition according to claim 1 wherein said composition is substantially free from volatile organic solvents.

3. The composition according to claim 1 wherein said composition comprises an amount of component (C) of at least about 25 to about 5000 parts per million.

4. The composition according to claim 3 wherein component (A) comprises molecules of which each contains at least one carboxyl group and, optionally, additional hydroxyl or carboxyl groups.

5. The composition according to claim 2 wherein component (A) is selected from the group consisting of gluconic acid, itaconic acid, hydroxyacetic acid, succinic acid, fumaric acid, potassium acid phthalate, tartaric acid, malonic acid, citric acid and mixtures thereof.

6. The composition according to claim 1 wherein (B) comprises at least one alkoxylated aromatic alcohol having 4 to 6 moles of ethoxylation.

7. The composition according to claim 2 wherein (B) comprises at least one nonionic surfactant selected from a benzyl alcohol ethoxylate and/or a phenol ethoxylate.

8. The composition according to claim 1 wherein component (C) is selected from at least one ammonium or alkali metal salt of a sulfonate of cumene.

9. The composition according to claim 1 further comprising an additional component of one or more water-soluble solvents selected from the group consisting of ethylene glycol n-butyl ether, diethylene glycol n-butyl ether, triethylene glycol methyl ether, propylene glycol n-butyl ether, dipropylene glycol methyl ether, propylene glycol methyl ether, and propylene glycol n-propyl ether.

10. A process for cleaning a soiled surface that comprises:

1) contacting a soiled surface with the cleaning composition according to claim 1 under the following conditions:

a. the composition is at a temperature of at least 35 to about 70° C.

b. the surface is contacted with the composition for a time of contact of from about 20 to about 120 seconds; and 2) thereafter, optionally, rinsing the surface with water.

11. The process according to claim 10 wherein during contacting step 1):

a. the composition is at a temperature of about 42 to about 60° C.; and b. the surface is contacted with the composition for a time of contact of from about 20 to about 120 seconds.

12. A cleaning composition comprising water and:

(A) about 0.2 g/l to about 6.0 g/l of a component of at least one carboxylic acid wherein said component comprises molecules of which each contains at least one carboxyl group and, optionally, additional hydroxyl or carboxyl groups;

(B) about 50 to about 3000 parts per million of a component of at least one surfactant selected from alkoxylated aromatic alcohols having no alkyl, ring substituents; and alkoxylated aromatic alcohols having one or more alkyl, ring substituents of one to four carbons;

(C) optionally, one or more salts of carboxylic acids selected from the group consisting of carboxylic acids that are the same as component (A), different from component (A) and mixtures thereof;

(D) about 25 to about 5000 parts per million of a hydrotrope material;

(E) an amount of pH adjuster such that the pH of said composition is not less than 1.0 and not more than 4.0;

(F) a component of one or more polyhydric alcohols; and (G) optionally, one or more preservatives.

13. The composition according to claim 12, comprising:

(B) about 100 to about 1000 parts per million of a component of at least one surfactant;

(D) about 25 to about 5000 parts per million of a hydrotrope material selected from at least one ammonium or alkali metal salt of a sulfonate of toluene, xylene, or cumene; and (F) about 10 to about 2000 parts per million of a component of one or more polyhydric alcohols.

14. The composition according to claim 12, produced by diluting an aqueous concentrate with water only, optionally after adjustment of pH by adding acid or base, said aqueous concentrate being present in an amount of from about 0.5 to about 5 vol % of the composition.

15. The composition according to claim 12, wherein:

(A) is selected from the group consisting of gluconic acid, itaconic acid, hydroxyacetic acid, succinic acid, fumaric acid, potassium acid phthalate, tartaric acid, malonic acid, citric acid and mixtures thereof;

(B) is selected from alkoxylated aromatic alcohols containing one or more compounds with an aromatic ring and ethoxylate units of general formula I:

I

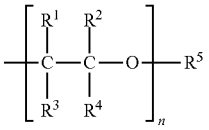

wherein: $R^1$, $R^2$, $R^3$ and $R^4$ are independently selected from hydrogen and methyl; $R^5$ is hydrogen; and n is 2, 3, 4, 5 or 6; said units of formula I being attached to the aromatic ring directly or through an ether (oxygen) linkage or an oxymethylene (—$CHR^{80}$—) linkage, wherein $R^8$ is hydrogen or $C_1$-$C_4$ alkyl;

(C) optionally, one or more salts of carboxylic acids selected from the group consisting of carboxylic acids that are the same as component (A), different from component (A) and mixtures thereof;

(D) about 25 to about 5000 parts per million of a hydrotrope material;

(E) an amount of pH adjuster such that the pH of said composition is not less than 1.0 and not more than 4.0;

(F) optionally, a component of one or more polyhydric alcohols; and (G) optionally, one or more preservatives.

16. The composition according to claim 15, wherein:

(A) comprises citric acid;

(B) comprises at least one alkoxylated benzyl alcohol having 2 to 6 moles of ethoxylation;

(D) comprises at least one ammonium or alkali metal salt of a sulfonate of toluene, xylene, or cumene;

wherein said cleaning composition comprises no more than about 0.5 percent by weight of phosphorus-containing components and no more than about 2 percent by weight of volatile organic solvents.

17. A cleaning composition comprising water and:

(A) at least one carboxylic acid;

(B) one or more aromatic, water soluble or dispersible, non-ionic surfactants selected from alkoxylated aromatic alcohols having no alkyl, ring substituents; and alkoxylated aromatic alcohols having one or more alkyl, ring substituents of one to four carbons;

(C) one or more water-soluble solvents selected from the group consisting of ethylene glycol n-butyl ether, diethylene glycol n-butyl ether, triethylene glycol methyl ether, propylene glycol n-butyl ether, dipropylene glycol methyl ether, propylene glycol methy ether, and propylene glycol n-propyl ether; and optionally, one or more of the following:

(D) one or more salts of carboxylic acids selected from the group consisting of carboxylic acids that are the same as component (A), different from component (A) and mixtures thereof;

(E) an amount of hydrotrope material sufficient to produce a stable homogeneous solution or dispersion of components (A) through (C) in water;

(F) a pH adjuster;

(G) one or more polyhydric alcohols; and (H) one or more preservatives;

wherein said cleaning composition comprises no more than about 1 percent by weight of phosphorus-containing components.

18. The composition according to claim 17 wherein said composition comprises an amount of component (E) of at least about 25 to about 5000 parts per million.

19. The composition according to claim 17 wherein component (A) comprises molecules of which each contains at least one carboxyl group and, optionally, additional hydroxyl or carboxyl groups.

20. The composition according to claim 17 wherein component (A) is selected from the group consisting of gluconic acid, itaconic acid, hydroxyacetic acid, succinic acid, fumaric acid, potassium acid phthalate, tartaric acid, malonic acid, citric acid and mixtures thereof.

21. The composition according to claim 17 wherein (B) comprises at least one alkoxylated aromatic alcohol having 4 to 6 moles of ethoxylation.

22. The composition according to claim 17 wherein (B) comprises at least one nonionic surfactant selected from a benzyl alcohol ethoxylate and/or a phenol ethoxylate.

23. The composition according to claim 17 wherein component (E) is selected from at least one ammonium or alkali metal salt of a sulfonate of toluene, xylene, or cumene.

24. A process for cleaning a soiled surface that comprises:

1) contacting a soiled surface with the cleaning composition according to claim 17 under the following conditions:

a. the composition is at a temperature of at least 35 to about 70° C.

b. the surface is contacted with the composition for a time of contact of from about 20 to about 120 seconds; and 2) thereafter, optionally, rinsing the surface with water.

25. The process according to claim 24 wherein during contacting step 1):

a. the composition is at a temperature of about 42 to about 60° C.; and b. the surface is contacted with the composition for a time of contact of from about 20 to about 120 seconds.

* * * * *